US010883283B2

(12) United States Patent
Faresin

(10) Patent No.: US 10,883,283 B2
(45) Date of Patent: Jan. 5, 2021

(54) SUPPORT DEVICE, OF THE DROP HEAD TYPE, FOR SUPPORTING BEAMS OF FORMWORKS FOR FLOOR SLABS, APPARATUS COMPRISING SUCH DEVICE AND SUPPORTING BEAM TO BE ASSOCIATED WITH THE DEVICE

(71) Applicant: FARESIN FORMWORK S.P.A., Breganze (IT)

(72) Inventor: Guido Faresin, Bassano del Grappa (IT)

(73) Assignee: FARESIN FORMWORK S.P.A., Breganze (IT)

( * ) Notice: Subject to any disclaimer, the term of this patent is extended or adjusted under 35 U.S.C. 154(b) by 0 days.

(21) Appl. No.: 16/264,846

(22) Filed: Feb. 1, 2019

(65) Prior Publication Data

US 2019/0277044 A1 Sep. 12, 2019

(30) Foreign Application Priority Data

Mar. 12, 2018 (IT) ..... 102018000003425

(51) Int. Cl.
*E04G 11/48* (2006.01)
*E04G 11/50* (2006.01)

(52) U.S. Cl.
CPC ..... *E04G 11/486* (2013.01); *E04G 11/50* (2013.01)

(58) Field of Classification Search
CPC ..... E04G 11/36; E04G 11/38; E04G 11/48; E04G 11/483; E04G 11/486; E04G 11/50
(Continued)

(56) References Cited

U.S. PATENT DOCUMENTS 1,907,877 A * 5/1933 Roos ..... E04G 11/486 249/193
3,614,048 A * 10/1971 Young ..... B28B 7/0032 249/18

(Continued)

FOREIGN PATENT DOCUMENTS

DE 2927116 * 1/1981 ..... E04G 11/486
DE 3147081 A1 * 12/1982 ..... E04G 11/486

(Continued)

OTHER PUBLICATIONS

Translation of KR 20090076813-A (Year: 2009).*

(Continued)

*Primary Examiner* — Michael Safavi
(74) *Attorney, Agent, or Firm* — Scully, Scott, Murphy & Presser, P.C.

(57) ABSTRACT

A support device, of the drop head type, for supporting beams of formworks for floor slabs, to an apparatus comprising such device, and to a supporting beam to be associated with the device; the device comprises an upright, a supporting head coupled to the upright, and a lower shank. The supporting head in turn comprises:

two plates which are arranged mirror-symmetrically and laterally adjacent to mutually opposite sides of the upright, at least two mirror-symmetrical recesses, each one obtained on a respective plate;

the device is provided with resting regions, of which one resting region is for resting the end of a supporting beam against a lateral part of the upright and a pair of mirror-symmetrical resting regions on the at least two recesses.

7 Claims, 4 Drawing Sheets

(58) Field of Classification Search
USPC ..... 248/357, 354.5, 354.6; 249/18, 26, 28
See application file for complete search history.

(56) References Cited

U.S. PATENT DOCUMENTS

| | | | | | |
|---|---|---|---|---|---|
| 3,784,151 | A * | 1/1974 | Steele | E04G 11/486 | 249/18 |
| 5,614,122 | A * | 3/1997 | Schworer | E04G 11/483 | 249/18 |
| 5,651,914 | A * | 7/1997 | Schworer | E04G 11/48 | 249/210 |
| 6,109,191 | A * | 8/2000 | Schworer | E04G 11/483 | 108/115 |
| 6,871,454 | B2 * | 3/2005 | Coday, Sr. | E04G 11/38 | 52/126.6 |
| 7,571,888 | B2 * | 8/2009 | Arozena Bergaretxe | E04G 11/38 | 108/156 |
| 7,581,709 | B2 * | 9/2009 | Gillespie | E04G 11/38 | 249/19 |
| 7,640,871 | B2 * | 1/2010 | Arozena Bergaretxe | E04G 11/38 | 108/150 |
| 8,262,056 | B2 * | 9/2012 | Schwoerer | E04G 11/483 | 248/357 |
| 8,313,079 | B2 * | 11/2012 | Schwoerer | E04G 11/483 | 249/18 |
| 9,540,830 | B2 * | 1/2017 | Rosati | E04G 17/001 | |
| 10,053,875 | B1 * | 8/2018 | Baron | E04G 11/50 | |
| 10,119,282 | B2 * | 11/2018 | Rosati | E04G 11/483 | |
| 2003/0012607 | A1 * | 1/2003 | Coday | E04G 11/38 | 405/272 |
| 2004/0075042 | A1 * | 4/2004 | Arozena Bergaretxe | E04G 11/38 | 249/210 |
| 2006/0042179 | A1 * | 3/2006 | Vanagan | E04G 11/56 | 52/633 |
| 2009/0250589 | A1 * | 10/2009 | Schworer | E04G 11/483 | 249/192 |
| 2009/0294627 | A1 * | 12/2009 | Schwoerer | E04G 11/483 | 249/18 |
| 2012/0042600 | A1 * | 2/2012 | Bacon | E04G 11/483 | 52/632 |
| 2014/0263941 | A1 * | 9/2014 | Zhang | E04G 11/38 | 249/18 |
| 2018/0080238 | A1 * | 3/2018 | Lenkin | E04B 5/10 | |

FOREIGN PATENT DOCUMENTS

| | | | | | |
|---|---|---|---|---|---|
| DE | 3316557 | C1 * | 10/1984 | E04G 11/486 | |
| DE | 3316557 | C1 | 10/1984 | | |
| DE | 3921064 | A1 * | 1/1991 | E04G 11/486 | |
| DE | 102010001042 | * | 7/2011 | E04G 11/486 | |
| EP | 0345902 | A2 * | 12/1989 | E04G 11/486 | |
| EP | 0430351 | A1 * | 6/1991 | E04G 11/50 | |
| EP | 1251222 | A2 * | 10/2002 | E04G 11/38 | |
| EP | 1375781 | A1 | 1/2004 | | |
| EP | 1617013 | A1 | 1/2006 | | |
| EP | 1861565 | A1 | 12/2007 | | |
| EP | 2372044 | A1 * | 10/2011 | E04G 11/483 | |
| EP | 3176349 | A1 | 6/2017 | | |
| FR | 2821104 | A1 * | 8/2002 | E04G 11/50 | |
| FR | 2900176 | A1 * | 10/2007 | E04G 11/50 | |
| GB | 1457136 | A * | 12/1976 | E04G 17/045 | |
| GB | 2265654 | * | 10/1993 | E04G 11/486 | |
| IT | 262876 | U | 3/2005 | | |
| KR | 20090076813 | A * | 7/2009 | E04G 11/486 | |
| WO | WO 2006/100694 | A1 | 9/2006 | | |
| WO | WO-2019156958 | A1 * | 8/2019 | E04G 11/38 | |
| WO | WO2019/190078 | * | 10/2019 | E04G 11/50 | |
| WO | WO-2019202623 | A1 * | 10/2019 | E04G 11/486 | |

OTHER PUBLICATIONS

U.S. Appl. No. 16/122,994, filed Sep. 6, 2018.
Italian Search Report dated Oct. 12, 2018 issued in IT 201800003425, with partial translation.

* cited by examiner

SUPPORT DEVICE, OF THE DROP HEAD TYPE, FOR SUPPORTING BEAMS OF FORMWORKS FOR FLOOR SLABS, APPARATUS COMPRISING SUCH DEVICE AND SUPPORTING BEAM TO BE ASSOCIATED WITH THE DEVICE

The present invention relates to a support device, of the drop head type, for supporting beams of formworks for floor slabs, to an apparatus comprising such device, and to a supporting beam to be associated with the device.

The invention can be applied in the construction sector, in the sector of apparatuses for construction.

In the construction of floor slabs the use is known of support devices of the type with a drop head for formwork supporting beams. Devices of this kind comprise an upright and a supporting head for at least one supporting beam of a panel of formwork, coupled along the upright.

According to some conventional embodiments of such devices, such as the one described in Italian patent for utility model no. 262876, of which an illustration is given in FIG. 1, in which this device is generally designated with the reference letter A, the supporting head B, which is of the drop head type, can slide along the upright C and there are means D associated therewith for the reversible locking of the supporting head in a preset position defined along the upright. The supporting head B, again according to the cited document, further comprises two plates E which are arranged mirror-symmetrically and laterally adjacent to mutually opposite sides of the upright, in order to delimit a region for accommodating the ends of supporting beams. Each plate E has a pair of recesses F, on opposite sides, each one for inserting an end portion of a supporting beam.

Such recesses F are substantially V-shaped, with side walls contoured to gradually veer away from each other.

Furthermore, typically, the supporting head has, in the lower part, as illustrated, a plate G from which a shank H protrudes in a downward region, to be inserted into the supporting prop, which is tubular, and at the upper end of the prop there is a complementary plate on which the head is locked to the prop, by joining the two plates by way of bolts.

Such support devices exhibit drawbacks which arise whenever it is necessary to provide planes that are inclined with respect to the ground, an operation that requires the setup of a formwork structure that reflects the required inclination.

Nowadays, in order to obtain inclined planes of formwork, the use is widespread of wedge-shaped wooden accessories to be inserted between the plate of the load-bearing head and the complementary plate of the prop.

The insertion of the wedge, which has a particular inclination, brings the load-bearing head, and therefore the supporting beams connected thereto, to a corresponding inclination.

Alternatively, wooden wedges can be positioned at the base of the prop, between the prop itself and the resting surface of the system of formwork, with an inclination of the wedge equal to the angle of inclination of the floor slab to be built.

From the operational point of view, in both cases operators can obtain different inclinations only if they have numerous and different wedges available. Furthermore, the use of wooden wedges entails an expenditure use of wood that is not reusable and a considerable deployment of labor. Moreover, such elements, being made of wood, have limitations in terms of strength and durability.

In U.S. Ser. No. 16/122,994, a device is described, shown in FIG. 2 and generally designated with the reference letter A', in which the recesses F' of the plates E' have a bottom I' which is substantially flat so as to define a variable resting point for the beam along the bottom, as a function of the inclination of the supporting beam.

Of the side walls of each recess, the one on the outer side is vertical, and acts as an abutment shoulder in order to prevent the resting beam from accidentally decoupling from the supporting head, and the other is contoured as described in the previous document.

The same document also describes means for coupling the device to the supporting prop, which comprise an engagement element which protrudes from the shank and is adapted to engage with the complementary plate of the prop.

The need is felt to provide inclined planes while limiting the instability of the beam coupled to the drop head during the transitional assembly phase.

The aim of the present invention is to provide a supporting device, of the drop head type, and an apparatus that are capable of improving the known art in one or more of the above mentioned aspects.

Within this aim, an object of the invention is to provide a support device, of the drop head type, that makes it possible to position the supporting beams of formworks for floor slabs according to an inclination that can vary as a function of the requirements, while at the same time ensuring the provision of a stable system.

Another object of the invention is to provide a supporting structure with beams that are inclined but which at the same time are structurally adapted to support the system of formwork.

Another object of the invention is to position inclined beams in a practical and rapid manner.

Another object of the invention is to provide a device with which to provide inclined formworks without the use of wooden wedges.

A further object of the present invention is to overcome the drawbacks of the known art in an alternative manner to any existing solutions.

Another object of the invention is to provide a device that is highly reliable, easy to implement and at low cost.

This aim and these and other objects which will become better apparent hereinafter are achieved by a support device, of the drop head type, for supporting beams of formworks for floor slabs, which comprises an upright, a supporting head coupled to said upright, and a lower shank, said supporting head in turn comprising:

- two plates which are arranged mirror-symmetrically and laterally adjacent to mutually opposite sides of said upright,
- at least two mirror-symmetrical recesses, each one obtained on a respective one of said plates, said device being characterized in that it is provided with resting regions, of which one resting region is for resting the end of a supporting beam against a lateral part of said upright and two are a pair of mirror-symmetrical resting regions on said at least two recesses, each one of said recesses being substantially V-shaped with at least one of the side walls being planar and inclined by an extent such as to define a variable resting along said side wall.

Further characteristics and advantages of the invention will become better apparent from the description of a preferred, but not exclusive, embodiment of the device according to the invention, which is illustrated by way of non-limiting example in the accompanying drawings wherein.

Figure 1:
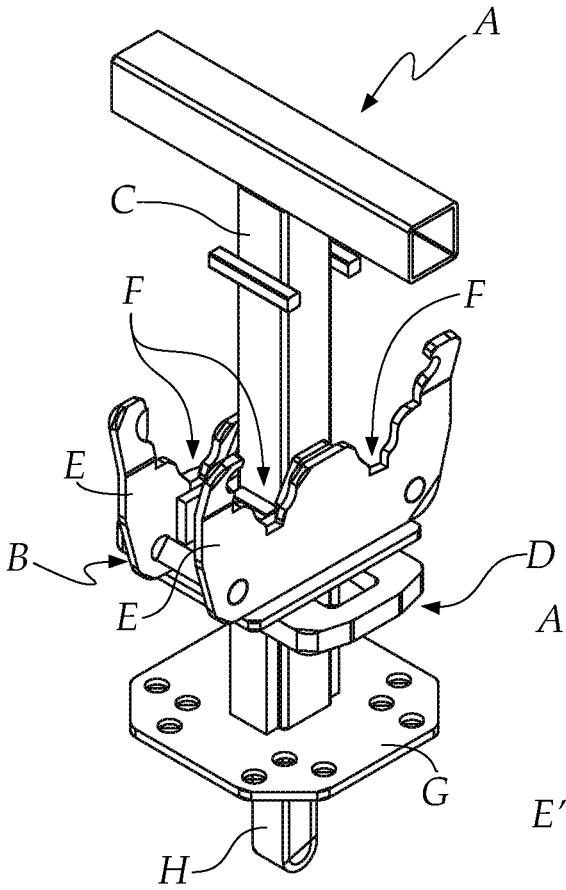
FIGS. 1 and 2 illustrate prior art solutions.
Figure 2:
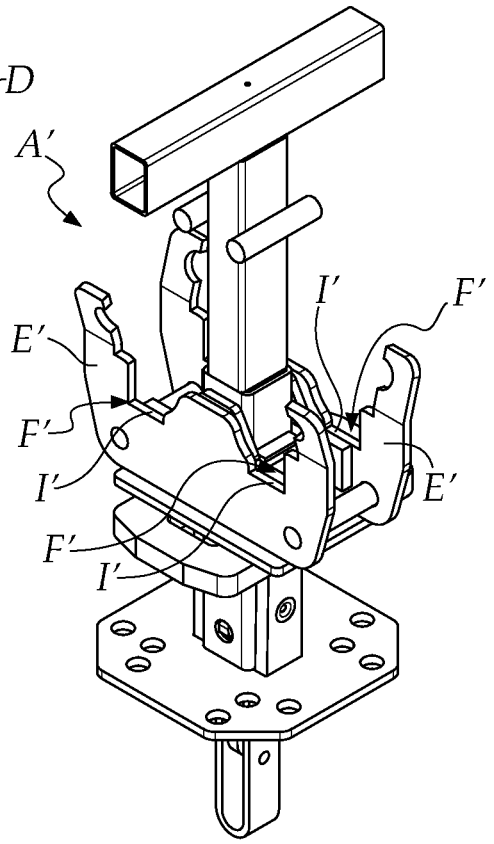

With reference to the figures, the device according to the invention, generally designated by the reference numeral 10, comprises an upright 11, a supporting head 12 coupled to the upright 11, for at least one supporting beam 13, and a lower shank 14 to be inserted into the hollow end of a supporting prop 15 which rests on the ground.

The supporting head 12 in turn comprises:

- two plates 16 which are arranged mirror-symmetrically, are laterally adjacent to opposite sides of the upright 11, and are suitable to laterally delimit two regions for accommodating the ends of two supporting beams 13,
- at least two mirror-symmetrical recesses 17, for guiding the insertion and for the containment of a resting portion of the corresponding supporting beam 13, each one of which is provided on a respective plate 16.

The device 10 is advantageously provided with resting regions 18, 19*a*, 19*b* for resting the supporting beam 13, of which one resting region 18 is for resting the end of the beam 13 against a lateral part of the upright 11 and the remaining two are a pair of mirror-symmetrical resting regions 19*a* and 19*b* on two mirror-symmetrical recesses 17, each recess 17 being substantially V-shaped with at least one of the side walls 20 being planar and inclined by an extent such as to define a variable resting along the side wall 20, as a function of the inclination of the supporting beam 13.

Each recess 17 is also provided with a flat bottom 21, substantially perpendicular to the axis of extension of the upright 11, for connection with the side wall 20 and optionally for resting the beam.

Figure 4:
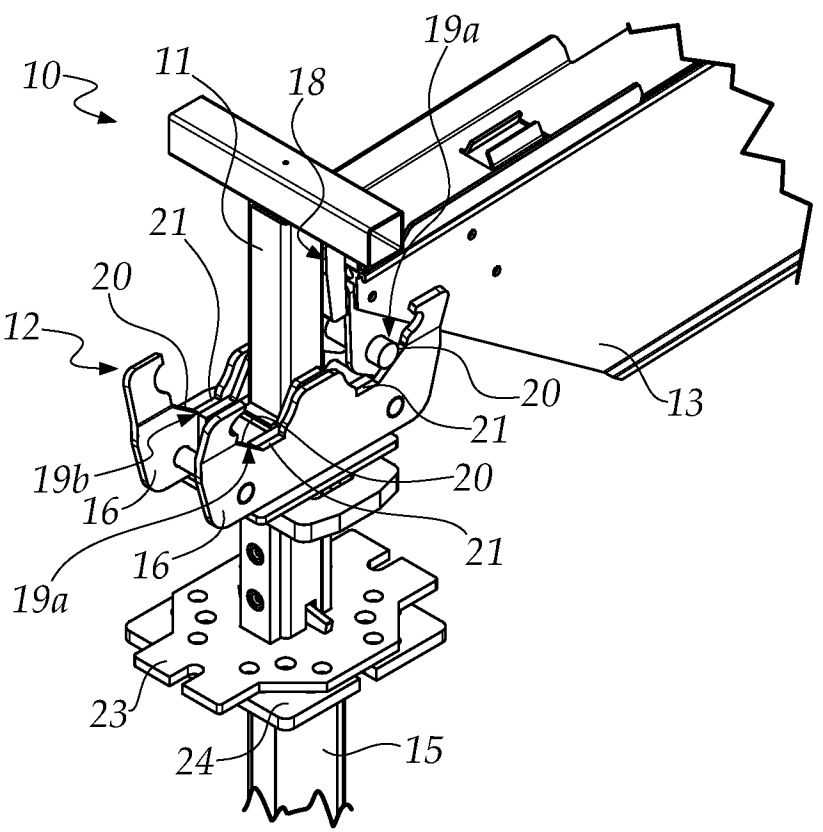
FIG. 4 is another perspective view of a device according to the invention with a supporting beam associated.
Figure 3:
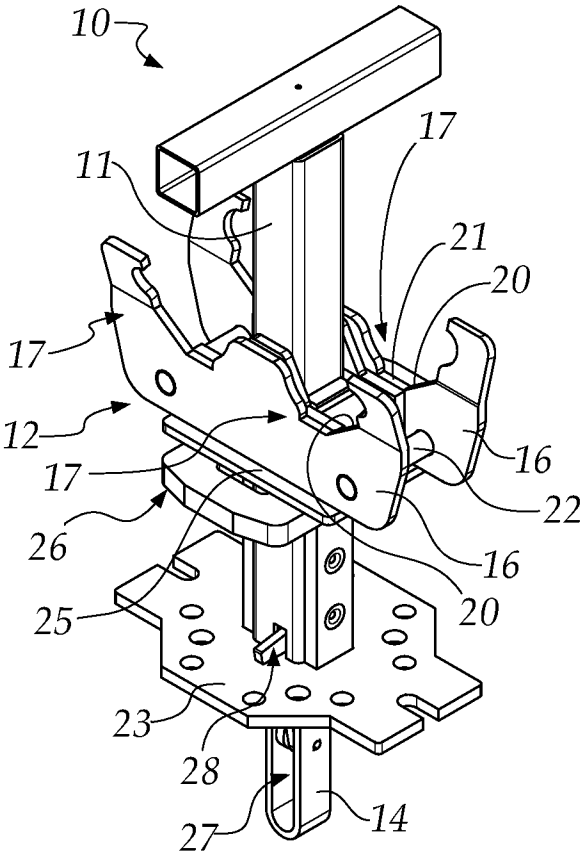
FIG. 3 is a perspective view of a device according to the invention.
Figure 5:
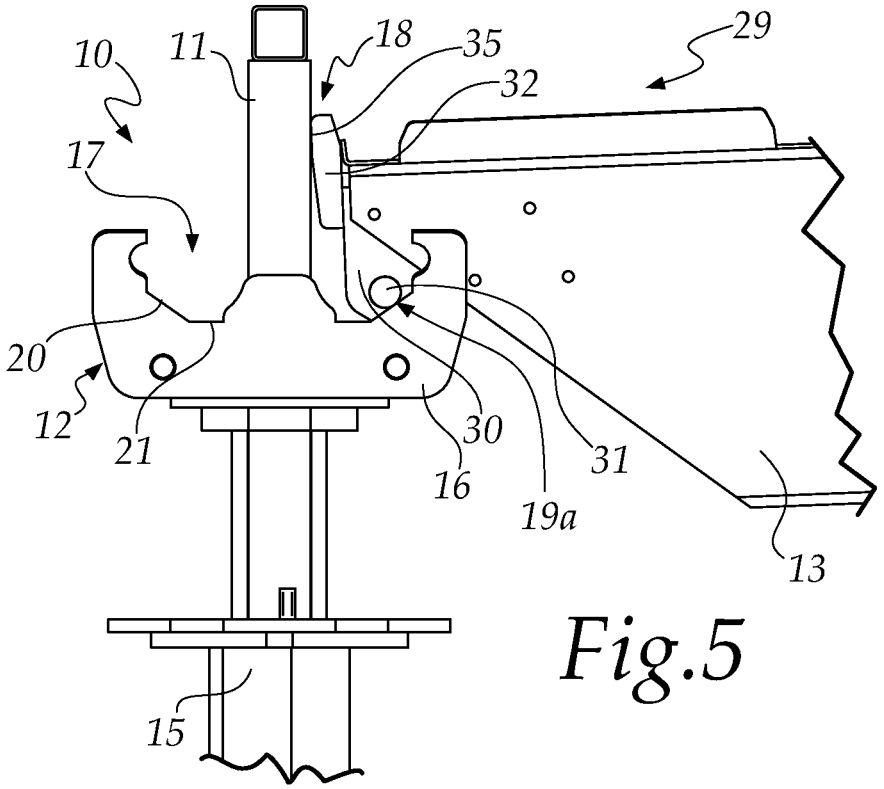
FIG. 5 is a side view of the device with the beam, as in FIG. 4.
Figure 6:
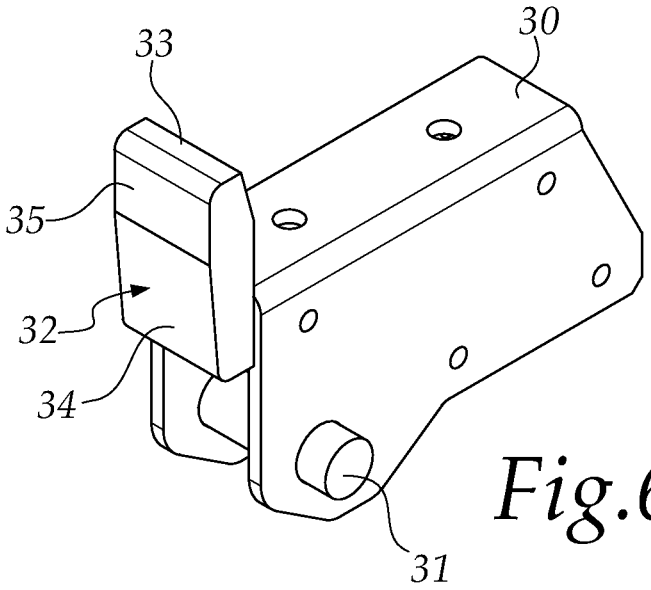
FIG. 6 is a detail of the supporting beam.

As can be seen in FIGS. 3 and 4, the supporting head 12 also comprises a crossmember 22 for connecting the two plates 16, which takes the form of a cylindrical pin welded at the ends to the two plates.

At the lower end of the upright 11 a plate 23 is provided from which, substantially aligned with the upright 11, extends the lower shank 14 which is to be inserted into the prop 15, which is tubular and is provided with a complementary plate 24 to which to lock the aforementioned plate 23 by way of bolts.

The supporting head 12 comprises a base plate 25, on which are cut-welded the two plates 16, arranged mirror-symmetrically and flanked by mutually opposite sides of the upright 11.

The supporting head 12 is slideably coupled on the upright 11 and is adapted to support two supporting beams 13 on opposite sides. In fact, in the example shown the plates 16 conveniently each have recesses 17 on opposite sides with respect to the upright 11 and are also mutually mirror-symmetrical, consequently defining two regions for accommodating the ends of contiguous and aligned supporting beams 13.

The base plate 25 has a through hole in the center, thus allowing the sliding thereof along the upright 11.

The supporting head 12 is associated with means 26, which are conventional, for reversibly locking the supporting head 12 in a position defined along the upright 11. In brief, such means for locking 26 comprise a frame that supports the base plate 25. These are described in Italian patent for utility model no. 262876.

In a conventional manner, the supporting head 12 is provided with safety and abutment elements for the end of the supporting beam 13 during the steps of erecting and removing that beam, which take the form of hooked portions that extend, in continuation of the upper portions of the recesses 17, outward and upward from the plates 16.

FIGS. 3 and 4 also show means for coupling the device 10 to the supporting prop 15, which comprise an engagement element 28 which protrudes from the shank 14 and is adapted to engage with the complementary plate of the prop 15. Such means for coupling 27 are conventional and described in U.S. Ser. No. 16/122,994.

In particular, it can be seen that the lower shank 14, which as mentioned protrudes from a plate 23 at the lower end of the upright 11, is open on opposite sides and inside it there is an engagement element 28 with which elastic means are associated and which can rotate about an axis which is transverse to the shank 14, from a first configuration to a second configuration for which it is adapted to protrude with a hook-shaped portion from an adapted hole provided in the upright 11 above the plate 23, the engagement element being pushed so as to rotate by the elastic means.

In the first configuration, not shown, the hooked portion is pushed manually by the operator toward the inside of the upright 11, thus causing the rotation of the engagement element 28 about an axis that is transverse to the shank 14, and therefore to the upright 11.

When the upright 11 is inserted into the prop 15, the push of the spring causes the return of the engagement element 28 to the initial position, i.e. the second configuration, in which the hooked portion is protruding from the hole of the upright 11 and is directed toward the upper face of the plate 23 and with an extraction-preventing shoulder below the upper plate 24 of the prop 15.

The coupling makes fixing the device 10 to the prop 15 faster and more practical.

The invention also relates to an apparatus comprising the device 10 and a supporting beam 13 that can be associated with the device 10. The apparatus is generally designated with the reference numeral 29 and has a peculiarity in that the supporting beam 13 is provided with:

- an inverted U-shaped bracket 30, which protrudes at least partially from at least one of the ends of the supporting beam 13,
- a horizontal pivot 31, which passes transversely through the bracket 30 in the part that protrudes from the beam end and which is adapted for resting the supporting beam 13 proper on the pair of mirror-symmetrical resting regions 19*a* and 19*b* on the two recesses 17,
- a resting element 32 for resting the supporting beam 13 against the upright 11, which is joined at its end to the bracket 30.

The horizontal pivot 31 has end parts that protrude from opposite sides of the bracket 30 and with which it is adapted to rest on the zones 19*a* and 19*b*.

The resting element 32 takes the form of a block butt-welded to the end of the beam 13 and is substantially vertical when the beam is positioned horizontally. The element 32 proper is welded in a higher position than the position of the horizontal pivot 31.

Also, the resting element 32 is contoured and, observed from the side, it can be seen that it has substantially two portions, an upper portion 33 and another, lower portion 34, which taper respectively upward and downward. The first is shorter than the other.

The lower portion is used for the join to the bracket 30, and the upper portion for resting, on the opposite side, against the upright 11.

The upper portion 33 has a wall 35 directed toward the outside of the beam, which rests against the upright 11 and is vertical when the beam is in the horizontal position.

The beam 13 is provided in a known manner with a central body that is constant in cross-section and two tapered portions which are adapted to the placement of brackets 30 with the pivots 31 and the resting elements 32. In the upper part of the beam 13 there is, in a conventional manner, a longitudinally extended contoured body with inclined teeth protruding upward.

Coupling of the supporting beam 13 to the device 10 occurs in the following manner.

The beam is placed with the horizontal pivot 31 at the end on the pair of resting regions 19*a* and 19*b* of the side walls 20 of two mirror-symmetrical recesses 17. In particular, the end of the beam is positioned inside the space defined by the side plates of the supporting head 12.

The resting element 32 encounters a vertical stop element in the upright 11 of the supporting head 12, in the resting region 18.

This type of coupling makes it possible to provide a variable inclination of the beam 13, as a function of the point that supports the horizontal pivot 31 on the side wall of the recesses 17. Furthermore the beam, in resting at each end at two points on the supporting head 12 (the pivot 31 and the element 32), is statically coupled and structurally adapted to the function of supporting the system of formwork.

The resting regions 18 and 19 constitute coupling points of the beam.

It should be noted that since the side wall 20 is flat and inclined to such an extent as to define a variable support, the spacing between the heads (or props) is always constant in all the inclinations allowed by the system.

The invention also relates to a supporting beam 13 to be associated with the device 10 and which has:

an inverted U-shaped bracket 30, which protrudes at least partially from at least one of the ends of the supporting beam 13, a horizontal pivot 31, which passes transversely through the bracket 30 in the part that protrudes from the beam end and which is adapted for resting the supporting beam 13 on the pair of mirror-symmetrical resting regions 19*a*, 19*b* on the at least two recesses 17, a resting element 32 for resting the supporting beam 13 against the upright 11, which is joined at its end to the bracket 30.

Figure 7:
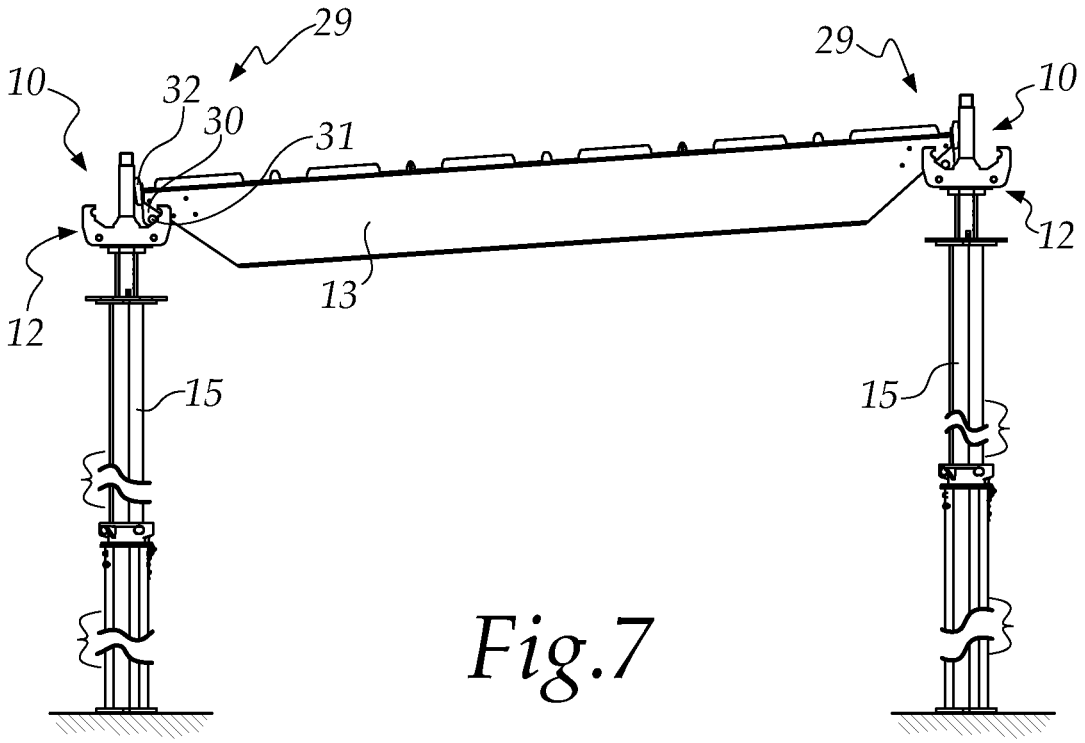
FIG. 7 is a side view showing an example of an apparatus with which a supporting beam is installed according to a particular inclination.
Figure 8:
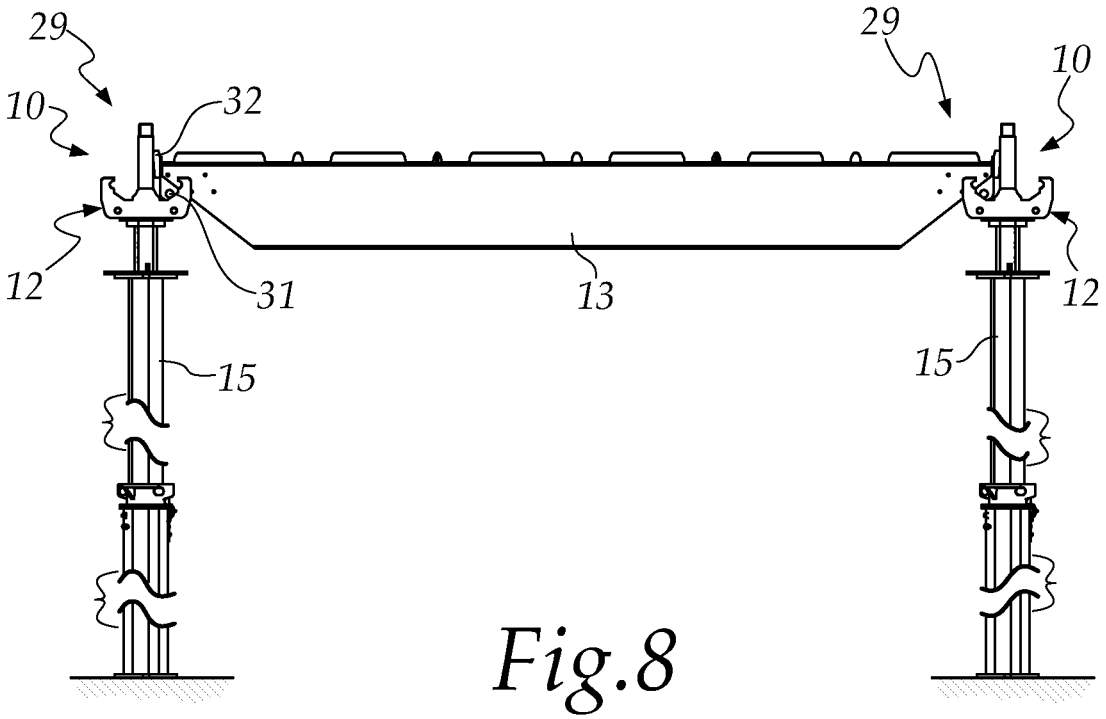
FIG. 8 is a side view showing an example of an apparatus with which a supporting beam is installed horizontally.

The apparatus 29, with the device 10 and the supporting beam 13 as described, makes it possible to position the beam inclined, as shown in FIG. 7, or horizontal, as illustrated in the subsequent FIG. 8, should it be necessary to provide a formwork with zero inclination. In this case the wall 35 of the element 32 rests completely against the vertical upright 11 of the head.

In practice it has been found that the invention fully achieves the intended aim and objects, by providing a support device and providing an apparatus that make it possible to position the supporting beams of formworks for floor slabs according to an inclination that can vary as a function of the requirements, while at the same time ensuring the provision of a system that is stable and structurally adapted to support a system of formwork.

The device proposed can also be rapidly and easily connected to and disconnected from the supporting props, by virtue of the means for coupling.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102018000003425 from which this application claims priority are incorporated herein by reference.

What is claimed is:

1. A support device, of the drop head type, for supporting beams of formworks for floor slabs, which comprises an upright, a supporting head coupled to said upright, and a lower shank, said supporting head in turn comprising:

two plates which are arranged mirror-symmetrically and laterally adjacent to mutually opposite sides of said upright, at least two mirror-symmetrical recesses, each one obtained on a respective one of said plates, wherein said lower shank, which protrudes from a shank plate at a lower end of said upright, is open on opposite sides and wherein inside said lower shank there is an engagement element with which elastic means are associated and which can rotate about an axis which is transverse to said lower shank, from a first configuration to a second configuration for which it is adapted to protrude with a hook-shaped portion from a hole provided in the upright above said shank plate, said engagement element being pushed so as to rotate by the elastic means, said device being provided with resting regions, of which one resting region is for resting the end of a supporting beam against a lateral part of said upright and two are a pair of mirror-symmetrical resting regions on said at least two recesses, each one of said recesses being substantially V-shaped with at least one of the side walls being planar and inclined by an extent such as to define a variable resting along said side wall.

2. The device according to claim 1, wherein each one of said at least two recesses is provided with a flat bottom, which is substantially perpendicular to the axis of extension of said upright.

3. The device according to claim 1, wherein said plates each have recesses on opposite sides with respect to said upright and are also mutually mirror-symmetrical.

4. An apparatus comprising a device according to claim 1 and a supporting beam which can be associated with said device, wherein said supporting beam has:

an inverted U-shaped bracket, which protrudes at least partially from at least one of ends of said supporting beam, a horizontal pivot, which passes transversely through said bracket in a part that protrudes from the end of the beam and which is adapted for resting said supporting beam on said pair of mirror-symmetrical resting regions on said at least two recesses, a resting element for resting said supporting beam against said upright, which is joined at its end to said bracket.

5. The apparatus according to claim 4, wherein said resting element comprises a contoured block which has substantially two portions, an upper portion and another, lower portion, which taper respectively upward and downward, the lower one for joining to said bracket, the upper one for resting, on an opposite side, on said upright.

6. The apparatus according to claim 5, wherein said upper portion has a wall directed toward the outside of the beam, which rests against said upright and is vertical when said beam is in a horizontal position.

7. A supporting beam, configured to associate with a device according to claim 1, comprising:

an inverted U-shaped bracket, which protrudes at least partially from at least one of ends of said supporting beam, a horizontal pivot, which passes transversely through said bracket in a part that protrudes from the end of the beam and which is adapted for resting said supporting beam on said pair of mirror-symmetrical resting regions on said at least two recesses, a resting element for resting said supporting beam against said upright, which is joined at its end to said bracket, wherein said resting element comprises a contoured block which has substantially two portions, an upper portion and another, lower portion, which taper respectively upward and downward, the lower one for joining to said bracket, the upper one for resting, on an opposite side, on said upright, and wherein the contoured block is fixed in a higher position than the position of the horizontal pivot.

* * * * *